US007717535B2

(12) United States Patent
Matsumoto et al.

(10) Patent No.: US 7,717,535 B2
(45) Date of Patent: May 18, 2010

(54) LIQUID EJECTION APPARATUS

(75) Inventors: Keiji Matsumoto, Matsumoto (JP); Kazunaga Suzuki, Azumino (JP); Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 452 days.

(21) Appl. No.: 11/699,944

(22) Filed: Jan. 29, 2007

(65) Prior Publication Data

US 2007/0182772 A1 Aug. 9, 2007

(30) Foreign Application Priority Data

Jan. 27, 2006 (JP) ..... 2006-019691

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 5,070,346 A * 12/1991 Mochizuki et al. ..... 347/7
6,086,178 A 7/2000 Kawashima
6,565,184 B1 * 5/2003 Numata et al. ..... 347/23

FOREIGN PATENT DOCUMENTS

| | | |
|---|---|---|
| JP | 5-185607 | 7/1993 |
| JP | 8-112912 | 5/1996 |
| JP | 8-332739 | 12/1996 |
| JP | 9-1818 A | 7/1997 |
| JP | 2000-158665 | 6/2000 |
| JP | 2002-120374 A | 4/2002 |
| JP | 2006-021380 | 1/2006 |

OTHER PUBLICATIONS

Machine translation of Detailed Description of JP 08-112912 A.*

* cited by examiner

*Primary Examiner*—Matthew Luu
*Assistant Examiner*—Justin Seo
(74) *Attorney, Agent, or Firm*—Nutter McClennen & Fish LLP; John J. Penny, Jr.

(57) ABSTRACT

A printer has a replaceable cartridge (ink pack), a recording head, and a control section. The recording head ejects ink supplied by the cartridge through a nozzle. The control section detects the retaining amount of the ink in the cartridge and the environmental temperature in the proximity of the printer. Further, the control section sets a threshold value, with reference to which it is determined whether the cartridge needs be replaced by a unused cartridge, to a lower value as the detected environmental temperature becomes higher.

9 Claims, 5 Drawing Sheets

| Environmental Temperature T(℃) | PA | PB |
|---|---|---|
| T<15 | PA1 | PB1 |
| 15<T≤20 | PA2 | PB2 |
| 20<T≤25 | PA3 | PB3 |
| 25<T≤30 | PA4 | PB4 |
| 30<T | PA5 | PB5 |

| Environmental Temperature T(℃) | KI (g) |
|---|---|
| T<15 | KI1 (=8) |
| 15<T≤20 | KI2 (=5) |
| 20<T≤25 | KI3 (=4) |
| 25<T≤30 | KI4 (=3. 7) |
| 30<T | KI5 (=3. 5) |

LIQUID EJECTION APPARATUS

CROSS-REFERENCE TO RELATED APPLICATION

This application is based upon and claims the benefit of priority from prior Japanese Patent Application No. 2006-019691, filed on Jan. 27, 2006, the entire content of which is incorporated herein by reference.

BACKGROUND

1. Technical Field

The present invention relates to a liquid ejection apparatus such as an inkjet printer.

2. Background Art

Typically, an inkjet printer is known as a liquid ejection apparatus that ejects liquid from a recording head, or a liquid ejection head, onto a target. The inkjet printer ejects ink onto a recording paper sheet as a target. The printer includes a recording head and a transport mechanism. The recording head is mounted in a carriage that reciprocates in a main scanning direction. The transport mechanism transports the recording paper sheet in a sub scanning direction. Nozzles are formed in the recording head for ejecting the ink, which is supplied from a cartridge (a liquid retaining body), onto the recording paper sheet.

A predetermined amount of ink is retained in the cartridge. The retaining amount of the ink gradually decreases as printing on the recording paper sheet is repeated. Japanese Laid-Open Patent Publication No. 2000-158665 describes a printer that indicates the need for replacement by a unused cartridge when the retaining amount of the ink in the cartridge becomes less than or equal to a predetermined threshold value.

The printer of Japanese Laid-Open Patent Publication No. 2000-158665 is an off-carriage type in which the cartridge is installed in a component other than a carriage. The ink is retained in an ink pack in the cartridge and flows to a recording head through an ink supply line through hydraulic head of the ink in the ink pack with respect to the recording head. The hydraulic head value P representing the hydraulic head applied to each nozzle of the recording head is obtained by the following equation:

$$P=p3-(p1+p2)$$

In the equation, p1 represents total resistance acting on the ink that has flown through the ink supply line from an ink pack side end to a recording head side end, which is dynamic pressure of the ink. p2 represents stiffness resistance of the ink pack. p3 represents the difference between the hydraulic head at an ink outlet of the ink pack and the hydraulic head in a nozzle of the recording head.

When printing by the printer of the aforementioned document is being performed or after such printing is completed, it is determined whether the hydraulic head value P is less than or equal to a minimum value that allows ink ejection from the nozzles of the recording head P (hereinafter, referred to as a "critical hydraulic head"). If it is determined that the pressure hydraulic head value P is less than or equal to the critical hydraulic head, it is indicated that the retaining amount of the ink in the ink pack is less than or equal to the threshold value. The critical hydraulic head is a predetermined fixed value. The threshold value is set in correspondence with the critical hydraulic head. The dynamic pressure p1 of the ink and the stiffness resistance p2 of the ink pack vary in correspondence with the temperature in the proximity of the printer (hereinafter, referred to as an "environmental temperature"), the length of the ink supply line, viscosity of the ink, and the remaining amount of the ink in the ink pack. Nonetheless, the dynamic pressure p1 of the ink and the stiffness resistance p2 of the ink pack are set to values determined under the most undesirable conditions.

The dynamic pressure p1 of the ink and the stiffness resistance p2 of the ink pack, with which the hydraulic head value P is calculated, increase as the environmental temperature drops. Therefore, the printer of the aforementioned publication sets the dynamic pressure p1 of the ink and the stiffness resistance p2 of the ink pack to values corresponding to a lower temperature (for example, 10° C.) to avoid ink shortage when printing is being carried out.

However, if the actual environmental temperature of the printer is higher (for example, 25° C.), the dynamic pressure p1 of the ink and the stiffness resistance p2 of the ink pack, which are set to the aforementioned values corresponding to the lower temperature, exceed the values corresponding to the actual environmental temperature. As a result, regardless of that a sufficient amount of ink is retained in the ink pack, it may be determined that the hydraulic head value P is less than or equal to the critical hydraulic head. In other words, the printer may indicate the need for replacement of the cartridge regardless of the sufficient retaining amount of the ink in the ink pack.

SUMMARY

Accordingly, it is an objective of the present invention to provide a liquid ejection apparatus that optimally determines the amount of liquid retained in a liquid retaining body before urging the replacement of the liquid retaining body due to decrease of the retaining amount of the liquid.

To achieve the foregoing objective and in accordance with a first aspect of the present invention, a liquid ejection apparatus including a replaceable liquid retaining body, a liquid ejection head, a retaining amount detecting section, a temperature detecting section, a threshold value setting section, and a determining section is provided. The liquid ejection head ejects a liquid supplied by the liquid retaining body through a nozzle. The retaining amount detecting section detects a retaining amount of the liquid in the liquid retaining body. The temperature detecting section detects an environmental temperature in the proximity of the liquid ejection apparatus. The threshold value setting section sets a threshold value, in accordance with which it is determined whether the liquid retaining body needs be replaced by a unused liquid retaining body, such that the higher the temperature detected by the temperature detecting section, the lower the threshold value becomes. The determining section determines whether the retaining amount detected by the retaining amount detecting section has become less than or equal to the threshold value.

In accordance with a second aspect of the present invention, a liquid ejection apparatus including a replaceable liquid retaining body, a liquid ejection head, a retaining amount detecting section, an indication device, a control section, a temperature detecting section, and a threshold value setting section is provided. The liquid ejection head ejects a liquid supplied by the liquid retaining body through a nozzle. The retaining amount detecting section detects a retaining amount of the liquid in the liquid retaining body. The control section compares the retaining amount detected by the retaining amount detecting section with a predetermined threshold value. When the retaining amount becomes less than or equal to the threshold value, the control section activates the indication device to urge replacement of the liquid retaining body.

The temperature detecting section detects the temperature in the proximity of the liquid ejection apparatus. The threshold value setting section sets the threshold value such that the higher the temperature detected by the temperature detecting section becomes, the lower the threshold value becomes.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF THE EXEMPLIFIED EMBODIMENTS

A first embodiment of the present invention will now be described with reference to FIGS. 1 to 8. In the description herein, a "front-and-rear direction", a "left-and-right direction", and an "up-and-down direction" correspond to the arrows in FIGS. 1 and 3.

Figure 1:
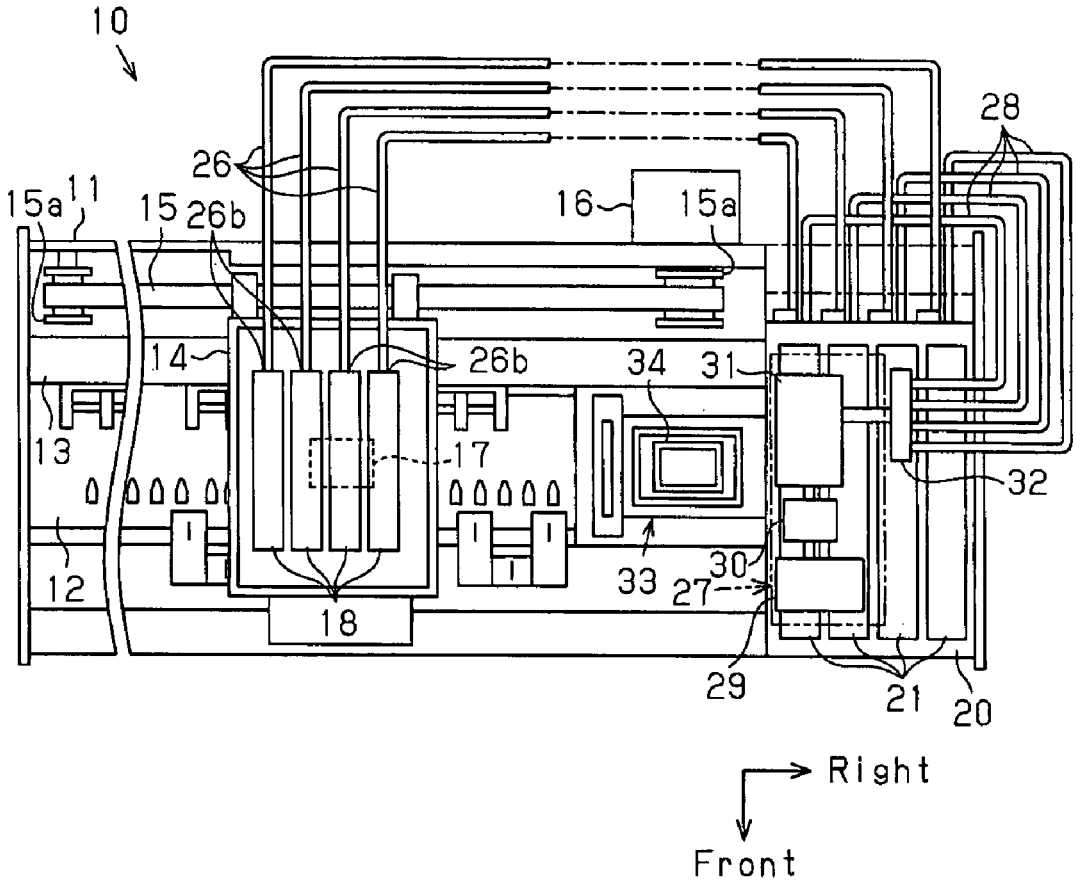
FIG. 1 is a plan view schematically showing an inkjet printer according to a first embodiment of the present invention.

As shown in FIG. 1, an inkjet printer (hereinafter, referred to as a printer) 10 as a liquid ejection apparatus includes a body frame 11 having a substantially box-like shape. A platen 12 extends in the body frame 11 and along the left-and-right direction. A non-illustrated recording paper sheet is supplied to the platen 12 by a paper feeder mechanism having a non-illustrated paper feeder motor. A bar-like guide member 13 is provided in the body frame 11 and extends parallel with the longitudinal direction (the left-and-right direction) of the platen 12.

The guide member 13 is passed through the carriage 14 and supports the carriage 14 in such a manner as to allow the carriage 14 to reciprocate along the axial direction of the guide member 13. The carriage 14 is connected to a carriage motor 16 through a timing belt 15 wound around a pair of pulleys 15*a*. The carriage 14 is driven by the carriage motor 16 to reciprocate in the axial direction of the guide member 13.

A recording head 17, or a liquid ejection head, is provided on the surface of the carriage 14 opposed to the platen 12. Valve units 18 are mounted in the carriage 14 to temporarily retain ink, or liquid, and supply the ink to the recording head 17. The number of the valve units 18 corresponds to the number of the colors (or the types) of the ink. In the first embodiment, four valve units 18 are employed. Nozzles 19 (see FIG. 3) are defined in the lower surface of the recording head 17. The nozzles 19 eject ink droplets onto the recording paper sheet (not shown), which is supplied to the platen 12. A thermistor SE1 (see FIG. 3) is arranged in the lower surface of the recording head 17.

Figure 2:
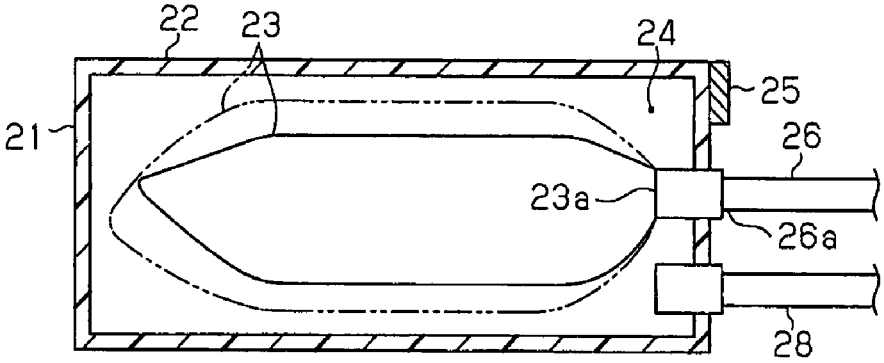
FIG. 2 is a cross-sectional view schematically showing a cartridge of the inkjet printer of FIG. 1.

A cartridge holder 20 is provided on a right end of the body frame 11. A plurality of cartridges 21 are removably provided in the cartridge holder 20. In the first embodiment, four cartridge holders 20 are provided in the cartridge holder 20. Referring to FIG. 2, each of the cartridges 21 includes a casing 22 having a rectangular cross section. An ink pack 23, or a liquid retaining body, is provided in an air chamber 24 defined in each of the casings 22. The ink packs 23 are filled with ink of different colors in correspondence with the cartridges 21.

An IC chip 25 is arranged on an outer surface of each casing 22. When the cartridges 21 are mounted in the cartridge holder 20, the IC chips 25 are electrically connected to a control section 60 (see FIG. 5) of the printer 10.

Each of the ink packs 23 is formed from a flexible film and has a bag-like shape. In FIG. 2, the two-dotted chain lines represent the state of the ink pack 23 when the ink has not yet been consumed, or the retaining amount of the ink is a maximum value (an initial value). In the drawing, the solid lines represent the state of the ink pack 23 when the ink has been slightly consumed and reduced. Each of the ink packs 23 is connected to the corresponding one of the valve units 18 in the carriage 14 through a corresponding one of ink supply lines 26, or liquid supply lines. The ink is ejected from each ink pack 23 to the exterior through an outlet 23*a*, which is a joint portion between the ink pack 23 and the corresponding ink supply line 26. The ink flows from an end 26*a* of the ink supply line 26 corresponding to the ink pack 23 to an end 26*b* of the ink supply line 26 corresponding to the recording head 17 and is temporarily retained in the corresponding valve unit 18.

A pressurization unit 27, or a pressurizing-supplying device, is provided in the vicinity of the cartridge holder 20. The pressurization unit 27 supplies pressurized air to the air chambers 24 of the cartridges 21 through an air supply line 28. The pressurization unit 27 includes a pressurization pump 29, a pressure sensor 30, and an atmospheric relief valve 31. The air supply line 28 is divided into four branches by a distributor 32, which is arranged downstream from the atmospheric relief valve 31. The four branches are each connected to the corresponding one of the cartridges 21.

An end of each of the branches of the air supply line 28 is provided in the air chamber 24 through the casing 22 of the corresponding cartridge 21. Therefore, when the pressurization pump 29 of the pressurization unit 27 is actuated, air is supplied under pressure from the pressurization pump 29 to the air chambers 24 of the cartridges 21 through the air supply line 28. The pressure of the pressurized air acts to squash the ink pack 23 of each air chamber 24, thus sending the ink from the ink pack 23 to the corresponding valve unit 18 through the ink supply line 26.

Figure 3:
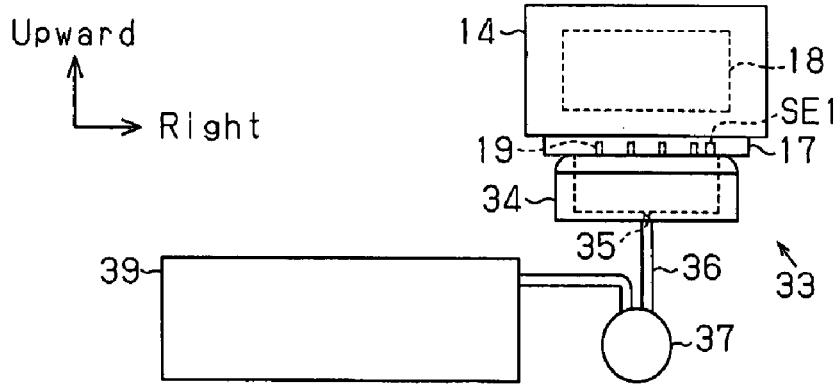
FIG. 3 is a diagrammatic view showing a maintenance unit of the inkjet printer of FIG. 1.

A home position of the carriage 14 is defined at a position near the right end of the body frame 11. A maintenance unit 33 is arranged at the home position. As shown in FIG. 3, the maintenance unit 33 has a cap 34, which forms a sealing body. The cap 34 has a rectangular box-like shape with an upper opening and is connected to a non-illustrated lift mechanism. When the carriage 14 is located at the home position, the lift mechanism raises the cap 34 to a position at which the cap 34 contacts the lower surface of the recording head 17. This airtightly seals the nozzles 19 of the recording head 17. An outlet port 35 is defined in the bottom wall of the cap 34. An outlet tube 36 is connected to the outlet port 35. The outlet port 35 is connected also to a waste ink tank 39. A suction pump 37 is provided in an intermediate portion of the outlet tube 36.

The pressurization unit 27 will hereafter be explained.

Figure 4:
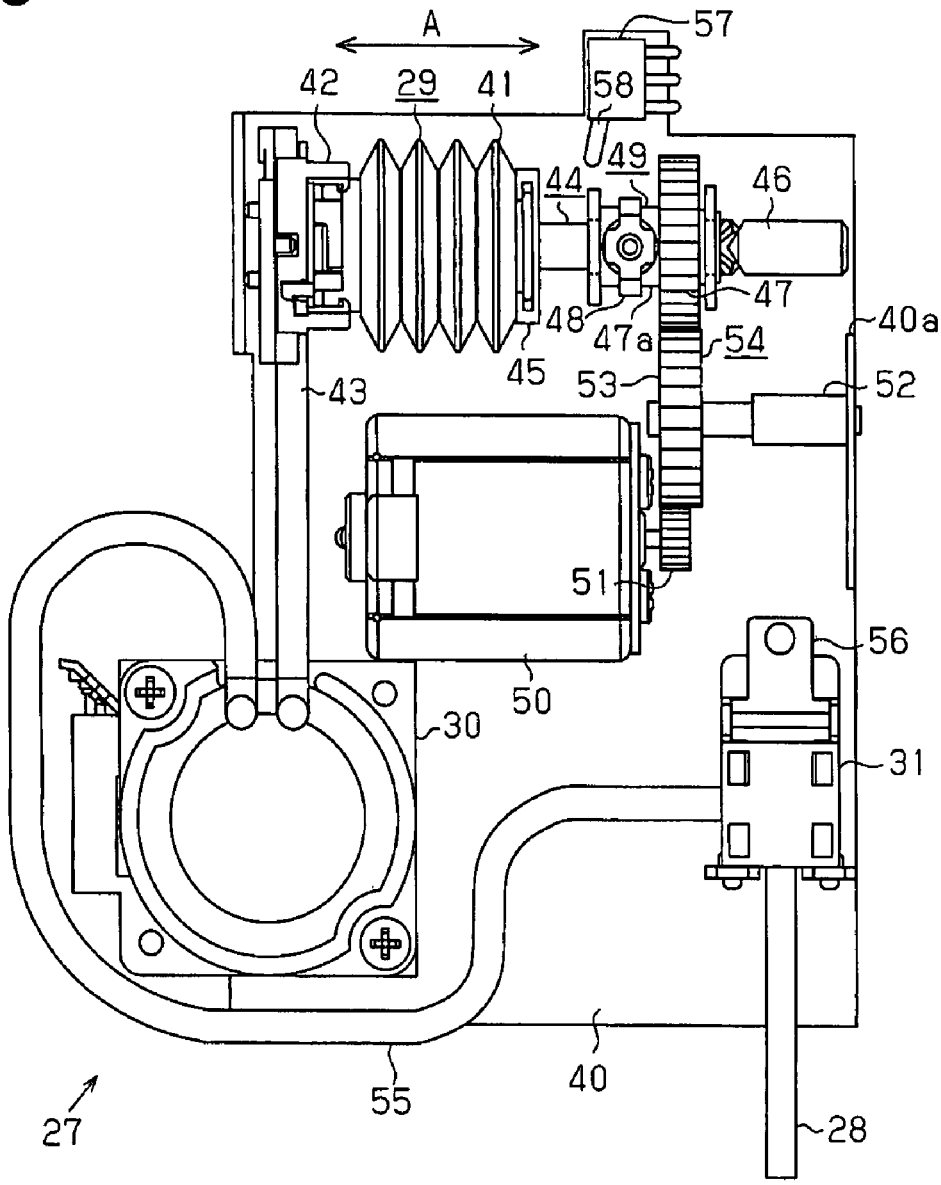
FIG. 4 is a plan view showing a pressurization unit of the inkjet printer of FIG. 1.

As shown in FIG. 4, the pressurization pump 29, the pressure sensor 30, and the atmospheric relief valve 31 are secured to a securing plate 40 to form a unit. The pressurization pump 29 is a diaphragm type pump (a volume type pump) and has an elastic member 41, which is formed of synthetic resin and has a bellows-like lidded cylindrical shape. An air accumulation chamber (not shown) is defined in the elastic member 41 and sealed by a sealing portion 42. An air outlet tube 43 is connected to the sealing portion 42 to introduce the air out of the pressurization pump 29.

A pressing member 44 is secured to the distal end of the elastic member 41. The pressing member 44 has a flat plate-like base 45 and a piston 46 formed integrally with the base 45. A non-illustrated cam groove is defined in the outer circumferential surface of the piston 46. The pressing member 44 has a first gear 47 through which the piston 46 is passed. The first gear 47 is thus supported rotatably about the piston 46.

A sliding portion 48 is provided between the base 45 and the first gear 47. The sliding portion 48 is secured to a projection 47*a* formed integrally with the first gear 47 and has a projection (not shown) projecting from the backside of the sliding portion 48. The projection slides along the cam groove, which is defined in the outer circumferential surface of the piston 46. When the first gear 47 rotates about the piston 46, the sliding portion 48 rotates about the piston 46. In this state, the projection slides along the cam groove. This causes the piston 46 to linearly reciprocate in the axial direction (direction A of FIG. 4) of the piston 46 in accordance with the shape of the cam groove.

As a result, the elastic member 41 engaged with the base 45 also extends and contracts as the piston 46 linearly reciprocates. This correspondingly increases and decreases the volume of the air accumulation chamber (not shown), supplying the air into the air outlet tube 43. In the first embodiment, the piston 46 and the sliding portion 48 form a cam mechanism 49.

A pressurization motor 50, which is a drive source of the pressurization pump 29, is secured to the securing plate 40. The pressurization motor 50 is a motor rotatable in opposing forward and reverse directions. A motor gear 51 is secured to the output shaft of the pressurization motor 50. A wall 40*a* projects from an end of the securing plate 40 with a support shaft 52 projecting from the wall 40*a*. A second gear 53 that is engageable with the motor gear 51 is rotatably supported by the support shaft 52.

The second gear 53 is engaged with the first gear 47. In the first embodiment, the motor gear 51, the first gear 47, and the second gear 53 form a gear mechanism 54. The rotation of the motor gear 51 of the pressurization motor 50 is transmitted to the first gear 47 through the gear mechanism 54 and converted into linear reciprocation by the cam mechanism 49. This causes the elastic member 41 to extend and contract.

When the piston 46 is moved closer to the elastic member 41 through operation of the gear mechanism 54 and the cam mechanism 49, the elastic member 41 contracts (air drainage), supplying the air from the air accumulation chamber (not shown) to the air outlet tube 43. In this state, if the piston 46 is moved separately from the elastic member 41 through operation of the gear mechanism 54 and the cam mechanism 49, the elastic member 41 extends (air suction), introducing the atmospheric air into the air accumulation chamber (not shown). As the pressurization pump 29 repeatedly performs the air drainage and the air suction in this manner, the air is sent through the air outlet tube 43 and the pressure in the air chamber 24 of each of the cartridges 21 increases in a stepped manner.

The air outlet tube 43 is connected to the pressure sensor 30. The pressure sensor 30 detects the pressure of the air sent from the pressurization pump 29 and outputs an electric signal in correspondence with the detection value of the pressure of the air. The pressure sensor 30 is connected to the atmospheric relief valve 31 through a communication pipe 55.

The atmospheric relief valve 31 is arranged between the communication pipe 55 and the air supply line 28 and has a valve opening lever 56. When the valve opening lever 56 is depressed, the atmospheric relief valve 31 operates to expose the air supply line 28 to the atmospheric air. When the valve opening lever 56 is in a non-depressed state, the air supply line 28 is disconnected from the atmospheric air. The air is thus supplied from the pressurization pump 29 to the air chambers 24 of the cartridges 21 through the air supply line 28. A non-illustrated valve opening mechanism is provided in the vicinity of the valve opening lever 56. The valve opening mechanism includes a gear mechanism connected to the pressurization motor 50 and a pressing member capable of pressing the valve opening lever 56. When the pressurization motor 50 rotates in a reverse direction, the pressing member presses the valve opening lever 56.

A home position detector 57 is arranged in the vicinity of the pressing member 44 of the pressurization pump 29 on the securing plate 40. The home position detector 57 detects the position of the elastic member 41. The home position detector 57 is formed by a limit switch or a photo sensor or the like and has a detection lever 58. When the elastic member 41 extends maximally, or the elastic member 41 is located at its home position, the base 45 of the pressing member 44 depresses the detection lever 58. In this state, the home position detector 57 outputs a detection signal.

The electric configuration of the above-described inkjet printer 10 will be explained with reference to FIG. 5.

Figures 5, 6, 7:
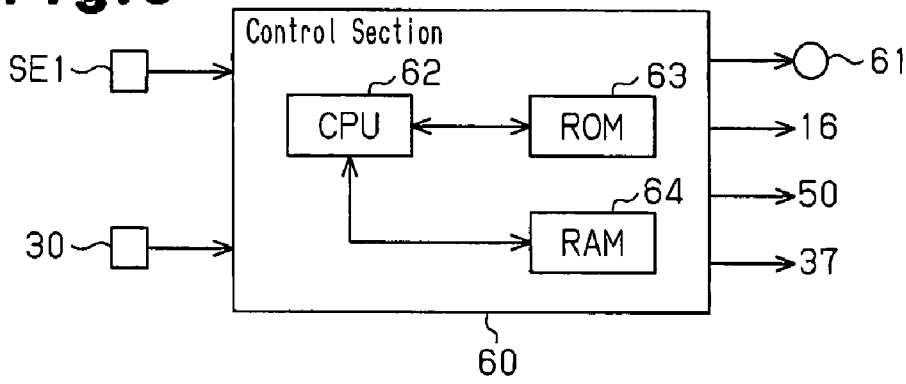
FIG. 5 is a block diagram representing the electric configuration of the inkjet printer of FIG. 1.
FIG. 6 is a table representing the relationship between the stiffness resistance of an ink pack and the dynamic pressure of ink in an ink supply line and the environmental temperature.
FIG. 7 is a table representing the relationship between the environmental temperature and the threshold value.

As illustrated in FIG. 5, the printer 10 has a control section 60. The thermistor SE1, the pressure sensor 30 and the like are connected to the control section 60 and provide electric signals to the control section 60. The paper feeder motor (not shown), the carriage motor 16, the pressurization motor 50, and the suction pump 37 are connected to the control section 60. The control section 60 drives the motors 16, 50, the suction pump 37 and the like. A plurality of (in the first embodiment, four) lamps 61, or indication devices provided in correspondence with the cartridges 21, are connected to the control section 60. Each of the lamps 61 is selectively turned on and off in correspondence with the retaining amount (the remaining amount) of the ink in the ink pack 23 of the corresponding one of the cartridges 21.

The control section 60 includes a CPU 62, with a ROM 63 and a RAM 64 connected to the CPU 62. The ROM 63 stores various types of control programs and tables in accordance with which the printer 10 is controlled. Specifically, the ROM 63 stores a table representing the relationship between the temperature in the proximity of the printer 10 (hereinafter, referred to as the environmental temperature) and the stiffness resistance of each ink pack 23, a table representing the relationship between the environmental temperature and the dynamic pressure of the ink in each ink supply line 26, and a table representing the relationship between the environmental temperature and the threshold value. With reference to the threshold value, a consumed cartridge 21 is replaced with a unused cartridge 21, or a cartridge 21 an ink pack 23 of which is fully filled with ink.

The ROM 63 further stores, in advance, hydraulic head difference, which is the difference between the hydraulic head at the ink outlet 23*a* of each ink pack 23 and the hydraulic head in each nozzle 19 of the recording head 17. In other words, the ROM 63 functions as a hydraulic head difference memory section that stores the hydraulic head difference between the hydraulic head at the ink outlet 23*a* of each ink pack 23 and the hydraulic head in each nozzle 19 of the recording head 17. In the first embodiment, the hydraulic head difference is a fixed value regardless of the environmental temperature and the remaining amount of the ink in each ink pack 23. The hydraulic head difference is set by a test or through simulation. The RAM 64 stores various types of information that are rewritten as needed when the printer 10 is in operation.

Next, the tables stored in the ROM 63 will be explained with reference to FIGS. 6 and 7.

The table of FIG. 6 represents the relationship between the environmental temperature T and the stiffness resistance PA of each ink pack 23 and the relationship between the environmental temperature T and the total resistance acting on the ink that has flown in each ink supply line 26 from the end 26*a* corresponding to the ink pack 23 to the end 26*b* corresponding to the recording head 17 (which is, hereinafter, referred to as "ink dynamic pressure PB").

Referring to FIG. 6, in the ROM 63, the stiffness resistance PA of each ink pack 23 is set to a first stiffness resistance PA1 and the ink dynamic pressure PB is set to a first dynamic pressure PB1 for the environmental temperature T lower than 15° C. (for example, 10° C.).

In the ROM 63, the stiffness resistance PA of each ink pack 23 is set to a second stiffness resistance PA2 and the ink dynamic pressure PB is set to a second dynamic pressure PB2 for the environmental temperature T higher than 15° C. but not higher than 20° C. (for example, 18° C.). The second stiffness resistance PA2 is less than the first stiffness resistance PA1 and the ink dynamic pressure PB2 is less than the ink dynamic pressure PB1.

In the ROM 63, the stiffness resistance PA of each ink pack 23 is set to a third stiffness resistance PA3 and the ink dynamic pressure PB is set to a third dynamic pressure PB3 for the environmental temperature T higher than 20° C. but not higher than 25° C. (for example, 22° C.). The third stiffness resistance PA3 is less than the second stiffness resistance PA2 and the ink dynamic pressure PB3 is less than the ink dynamic pressure PB2.

In the ROM 63, the stiffness resistance PA of each ink pack 23 is set to a fourth stiffness resistance PA4 and the ink dynamic pressure PB is set to a fourth dynamic pressure PB4 for the environmental temperature T higher than 25° C. but not higher than 30° C. (for example, 30° C.). The fourth stiffness resistance PA4 is less than the third stiffness resistance PA3 and the ink dynamic pressure PB4 is less than the ink dynamic pressure PB3.

Further, in the ROM 63, the stiffness resistance PA of each ink pack 23 is set to a fifth stiffness resistance PA5 and the ink dynamic pressure PB is set to a fifth dynamic pressure PB5 for the environmental temperature T higher than 30° C. (for example, 35° C.).

Specifically, the stiffness resistance PA of each ink pack 23 and the ink dynamic pressure PB become less as the environmental temperature T becomes higher. To facilitate understanding, in the first embodiment, it is defined that the stiffness resistances PA of the ink packs 23 of all of the cartridges 21 are equal at a common environmental temperature T. Similarly, it is defined that the ink dynamic pressures PB of all of the cartridges 21 are equal at a common environmental temperature T.

The table of FIG. 7 represents the relationship between the environmental temperature T and a threshold value KI with respect to the retaining amount of the ink of each ink pack 23. Referring to FIG. 7, in the ROM 63, the threshold value KI is set to a first threshold value KI1 for the environmental temperature T not higher than 15° C. For example, the first threshold value KI1 of 8 g is set for the environmental temperature T of 15° C.

In the ROM 63, the threshold value KI is set to a second threshold value KI2 for the environmental temperature T higher than 15° C. but not higher than 20° C. That is, the second threshold value KI2 is less than the first threshold value KI1. For example, the second threshold value KI2 of 5 g is set for the environmental temperature T of 16° C.

In the ROM 63, the threshold value KI is set to a third threshold value KI3 for the environmental temperature T higher than 20° C. but not higher than 25° C. That is, the third threshold value KI3 is less than the second threshold value KI2. For example, the third threshold value KI3 of 4 g is set for the environmental temperature T of 24° C.

In the ROM 63, the threshold value KI is set to a fourth threshold value KI4 for the environmental temperature T higher than 25° C. but not higher than 30° C. That is, the fourth threshold value KI4 is less than the third threshold value KI3. For example, the fourth threshold value KI4 of 3.7 g is set for the environmental temperature T of 26° C.

Further, the threshold value KI is set to a fifth threshold value KI5 for the environmental temperature T higher than 30° C. That is, the fifth threshold value KI5 is less than the fourth threshold value KI4. For example, the fifth threshold value KI5 of 3.5 g is set for the environmental temperature T of 31° C.

Specifically, the ROM 63 functions as a memory section that stores the multiple threshold values KI1 to KI5 in correspondence with variation of the environmental temperature T. To facilitate understanding, in the first embodiment, it is defined that, regardless of the type of the ink, the threshold values KI corresponding to the ink packs 23 of all of the cartridges 21 are equal at a common environmental temperature T.

Figure 8:
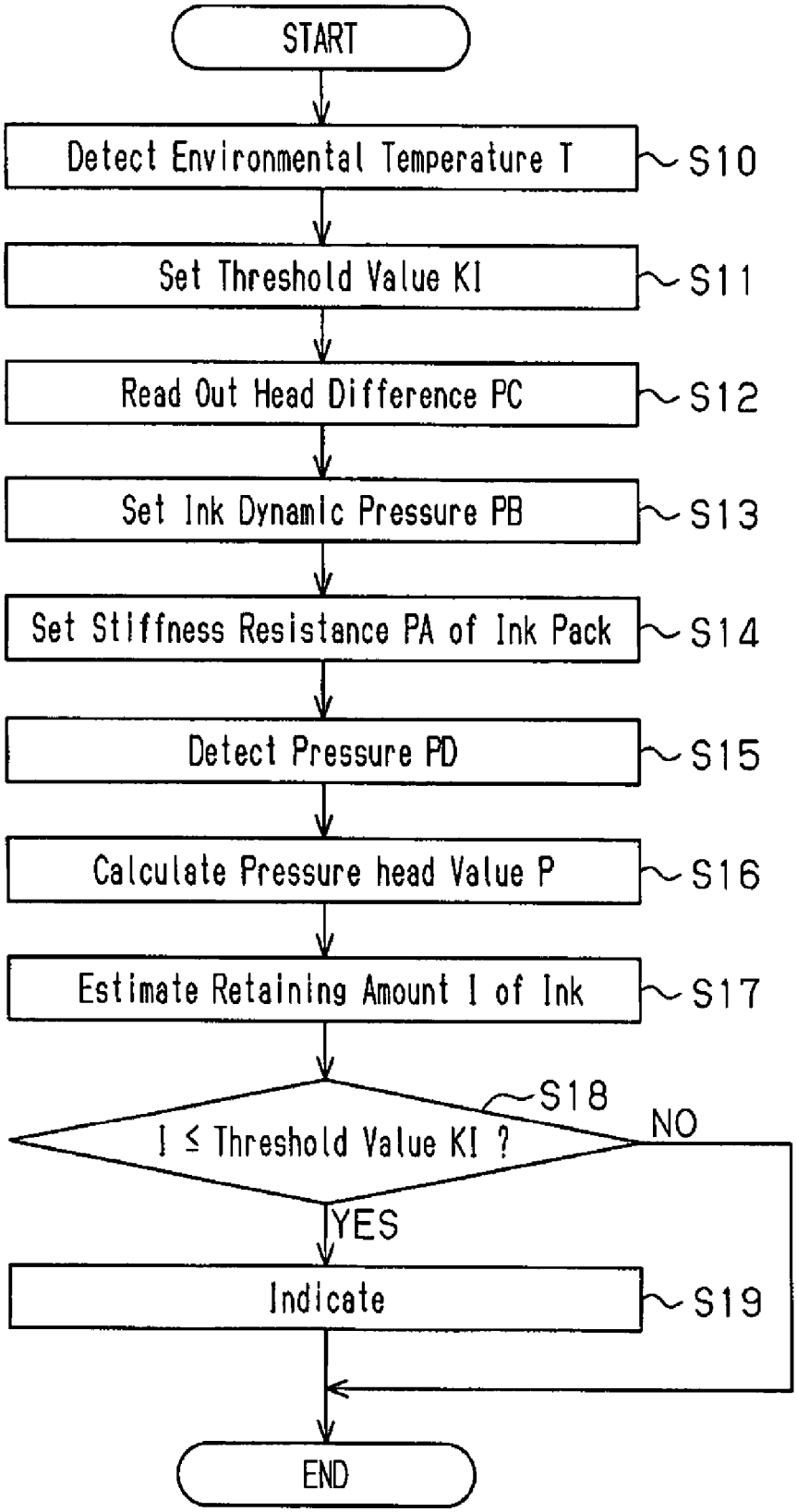
FIG. 8 is a flowchart representing a routine of a replacement indication determining procedure.

Next, a replacement indication determining routine, which is one of control routines executed by the control section 60, will be explained with reference to FIG. 8. In accordance with the replacement indication determining routine, it is determined whether indication of the need for replacement of a cartridge 21 should be carried out.

The control section 60 executes the replacement indication determining routine by predetermined cycles of, specifically, one second, for example. In the replacement indication determining routine, the control section 60 receives a signal generated by the thermistor SE1 and calculates the environmental temperature T based on the signal (in step S10). In other words, in the first embodiment, the control section 60 and the thermistor SE1 function as a temperature detecting section that detects the environmental temperature T. Specifically, the thermistor SE1 functions as a temperature signal generating section and the control section 60 functions as a temperature calculating section.

Subsequently, the control section 60 sets the threshold value KI in correspondence with the environmental temperature T, which is detected in step S10 (in step S11). Specifically, the control section 60 reads out the threshold value KI corresponding to the environmental temperature T detected in step S10 from the threshold values KI1 to KI5 stored in the ROM 63. The control section 60 then sets the obtained threshold value KI in a predetermined area in the RAM 64. For example, if the environmental temperature T detected in step S10 is 25° C., the control section 60 reads out the third threshold value KI3 and sets the threshold value KI3 in a predetermined area in the RAM 64. In other words, in the first embodiment, the control section 60 functions as a threshold value setting section that sets the threshold value KI to a lower value as the environmental temperature T detected in step S10 becomes higher.

The control section 60 then reads out the hydraulic head difference PC corresponding to each of the cartridges 21 and sets the obtained hydraulic head differences PC in a predetermined area in the RAM 64 (in step S12). Further, in correspondence with the environmental temperature T detected in step S10, the control section 60 sets the ink dynamic pressure B (in step S13). Specifically, the control section 60 reads out the ink dynamic pressure PB corresponding to the environmental temperature T detected in step S10 from the ink dynamic pressures PB1 to PB5 and sets the obtained dynamic pressure PB in a predetermined area of the RAM 64. For example, if the environmental temperature T from step S10 is 27° C., the control section 60 reads out the fourth dynamic pressure PB4 and sets the fourth dynamic pressure PB4, which has been read out, in a predetermined area of the RAM 64. In other words, in the first embodiment, the control section 60 functions as a dynamic pressure detecting section that detects the ink dynamic pressure PB in correspondence with the environmental temperature T, which has been detected in step S10.

Then, the control section 60 sets the stiffness resistance PA of each ink pack 23 in correspondence with the environmental temperature T from step S10 (in step S14). That is, the control section 60 reads out the stiffness resistance PA corresponding to the environmental temperature T detected in step S10 from the stiffness resistances PA1 to PA5 stored in the ROM 63. The control section 60 then sets the obtained stiffness resistance PA in a predetermined area of the RAM 64. For example, if the environmental temperature T detected in step S10 is 18° C., the control section 60 reads out the second stiffness resistance PA2 and sets the second stiffness resistance PA2 in a predetermined area of the RAM 64. In the first embodiment, the control section 60 functions as a stiffness resistance setting section that sets the stiffness resistance PA of each ink pack 23.

Next, in correspondence with a signal from the pressure sensor 30, the control section 60 detects the pressure PD applied to the ink in the ink pack 23 of each cartridge 21 by the pressurization unit 27 (in step S15). In the first embodiment, the control section 60 and the pressure sensor 30 function as a pressure detecting section that detects the pressure PD applied to the ink in each ink pack 23 by the pressurization unit 27.

From the results obtained from processing in step S12 to step 515, the control section 60 calculates the hydraulic head value P (in step S16). The hydraulic head value P is obtained by the following equation:

$$P=(PC+PD)-(PA+PB) \quad (1)$$

Specifically, the control section 60 calculates a first sum (PC+PD) by adding the hydraulic head difference PC detected in step S12 to the pressure PD detected in step S15. The control section 60 also calculates a second sum (PA+PB) by adding the ink dynamic pressure PB detected in step S13 to the stiffness resistance PA of each ink pack 23. Further, by subtracting the second sum (PA+PB) from the first sum (PC+PD), the control section 60 obtains the hydraulic head value P.

Subsequently, based on the hydraulic head value P obtained in step S16, the control section 60 estimates the retaining amount, which is the remaining amount I, of the ink in the ink pack 23 of each cartridge 21 (in step S17). That is, in the first embodiment, the control section 60, the thermistor SE1, and the pressure sensor 30 function as a retaining amount detecting section that detects the retaining amount I of the ink in each ink pack 23.

The control section 60 then determines whether the retaining amount I of the ink in each ink pack 23, which has been detected in step S17, is less than or equal to the threshold value KI that has been set in step S11 (in step S18). In the first embodiment, the control section 60 thus functions also as a determining section. If it is determined that the retaining amount I of the ink in each ink pack 23 is higher than the threshold value KI (I>KI) in step S18, the control section 60 determines that the amount of the ink retained in each ink pack 23 is sufficient for the current environmental temperature T. The control section 60 thus suspends the replacement indication determining routine.

Contrastingly, if it is determined that the retaining amount I of the ink in each ink pack 23 is less than or equal to the threshold value KI (I<KI) in step S18, the control section 60 determines that the amount of the ink in each ink pack 23 is insufficient under the current environmental temperature T. In other words, the control section 60 determines that, in printing on the recording paper sheet, ink shortage may occur. In this case, the control section 60 illuminates the lamp 61 corresponding to the cartridge 21 in which the ink shortage may occur, thus indicating the need for replacement of the cartridge 21 to a non-used cartridge 21 (in step S19).

The control section 60 then ends the replacement indication determining routine. After the replacement of the cartridge 21 by the unused cartridge 21 is completed, the control section 60 turns off the lamp 61 that has been illuminated in step S19.

Operation of the printer 10 will hereafter be described. The following description explains, particularly, the operation of the printer 10 when the retaining amount I of the ink in the ink pack 23 of the cartridge 21 becomes less than or equal to the threshold value KI. In the first embodiment, the environmental temperature T of the printer 10 is 25° C.

As ink droplets are ejected from the nozzles 19 of the recording head 17 onto the recording paper sheet, which has been supplied by the paper feeder mechanism, the retaining amount I of the ink in the ink pack 23 of each cartridge 21 gradually decreases. The environmental temperature T (25° C.) of the printer 10 is detected in correspondence with a signal generated by the thermistor SE1, which is provided in the recording head 17 at predetermined cycles. The threshold value KI corresponding to the environmental temperature T is read out from the corresponding one of the tables stored in the ROM 63. In the first embodiment, since the environmental temperature T is 25° C., the threshold value KI is set to the third threshold value KI3.

Subsequently, the hydraulic head difference PC in each of the cartridges 21 is read out from the ROM 63. Further, the stiffness resistance PA of each ink pack 23 and the ink dynamic pressure PB corresponding to the detected environmental temperature T are read out from the corresponding one of the tables stored in the ROM 63. In the first embodiment, since the environmental temperature T is 25° C., the stiffness resistance PA of each ink pack 23 and the ink dynamic pressure PB are set to the third stiffness resistance PA3 and the third dynamic pressure PB3, respectively.

Next, the pressure PD is detected in correspondence with a signal of the pressure sensor 30. The control section 60 then calculates the hydraulic head values P using the aforementioned equation (1). The control section 60 thus estimates the retaining amount I of the ink in the ink pack 23 of each cartridge 21 using the corresponding one of the hydraulic head values P.

Then, it is determined whether the retaining amount I of the ink has become less than or equal to the threshold value KI for each of the cartridges 21. If it is determined that the retaining amount I of the ink has become less than or equal to the threshold value KI ($I \leqq KI$) in any one of the cartridges 21, the corresponding one of the lamps 61 is turned on. This urges replacement of the cartridge 21, which has been determined to have an insufficient retaining amount I of ink in the ink pack 23 under the detected environmental temperature T, by a unused cartridge 21. After the completion of such replacement is detected, the lamp 61 is turned off.

The first embodiment has the following advantages.

(1) The threshold value KI, in accordance of which it is determined whether any one of the cartridges 21 accommodating the ink packs 23 needs be replaced, is set in correspondence with the environmental temperature T detected based on the signal of the thermistor SE1. If the environmental temperature T of the printer 10 is relatively high, the hydraulic head value P of each nozzle 19 of the recording head 17 is relatively low. The threshold value KI is thus set to a relatively small value. This reduces the amount of the ink remaining in the ink pack 23 of the cartridge 21 to be replaced, when replacement of the cartridge 21 is urged due to decrease of the retaining amount I of the ink.

(2) The threshold value KI, with reference to which it is determined whether to replace the cartridges 21, is set by reading out the threshold value KI corresponding to the environmental temperature T detected in correspondence with the signal of the thermistor SE1 from the ROM 63. This makes it unnecessary to perform a calculation procedure using an equation. The load of the control section 60 is thus decreased.

(3) Since the thermistor SE1 is provided in the recording head 17, which ejects ink, the temperature at a position closer to the ink ejected from the nozzles 19 is detected. The threshold value KI is thus set to a value approximate to the lower limit of the hydraulic head (hereinafter, referred to also as "critical hydraulic head") that allows ejection of the ink from the nozzles 19 of the recording head 17.

(4) When the retaining amount I of the ink in each ink pack 23, which corresponds to the hydraulic head value P, becomes less than or equal to the threshold value KI, indication by the lamps 61 are performed. The threshold value KI is set to the value corresponding to the critical hydraulic head. This effectively reduces the amount (the retaining amount I) of the ink remaining in the ink packs 23 of the cartridges 21 when the cartridges 21 are replaced.

(5) The pressure PD applied to the ink in each ink pack 23 by the pressurization unit 27 is detected in correspondence with a signal of the pressure sensor 30 of the pressurization unit 27. The first sum is calculated by adding the hydraulic head difference PC read out from the ROM 63 and the pressure PD together. The second sum is obtained by adding the stiffness resistance PA of the ink pack 23 set by the control section 60 and the dynamic pressure PB of the ink in the ink supply line 26 together.

In other words, the second sum is set to a value corresponding to the environmental temperature T, which is detected in correspondence with the signal of the thermistor SE1. The hydraulic head value P is obtained by subtracting the second sum from the first sum. Therefore, regardless of the presence of the pressurization unit 27, the amount of the ink remaining in the ink pack 23 of the cartridge 21 that is to be replaced is effectively reduced in correspondence with the environmental temperature T, which is detected based on the signal of the thermistor SE1.

Next, a second embodiment of the present invention will be explained with reference to FIG. 9. A liquid ejection apparatus 10A of the second embodiment is different from the liquid ejection apparatus 10 of the first embodiment in that cartridges 21 are mounted in a carriage 14. Therefore, the following explanation will refer only to the differences between the liquid ejection apparatus 10A of the second embodiment and the liquid ejection apparatus 10 of the first embodiment.

Figure 9:
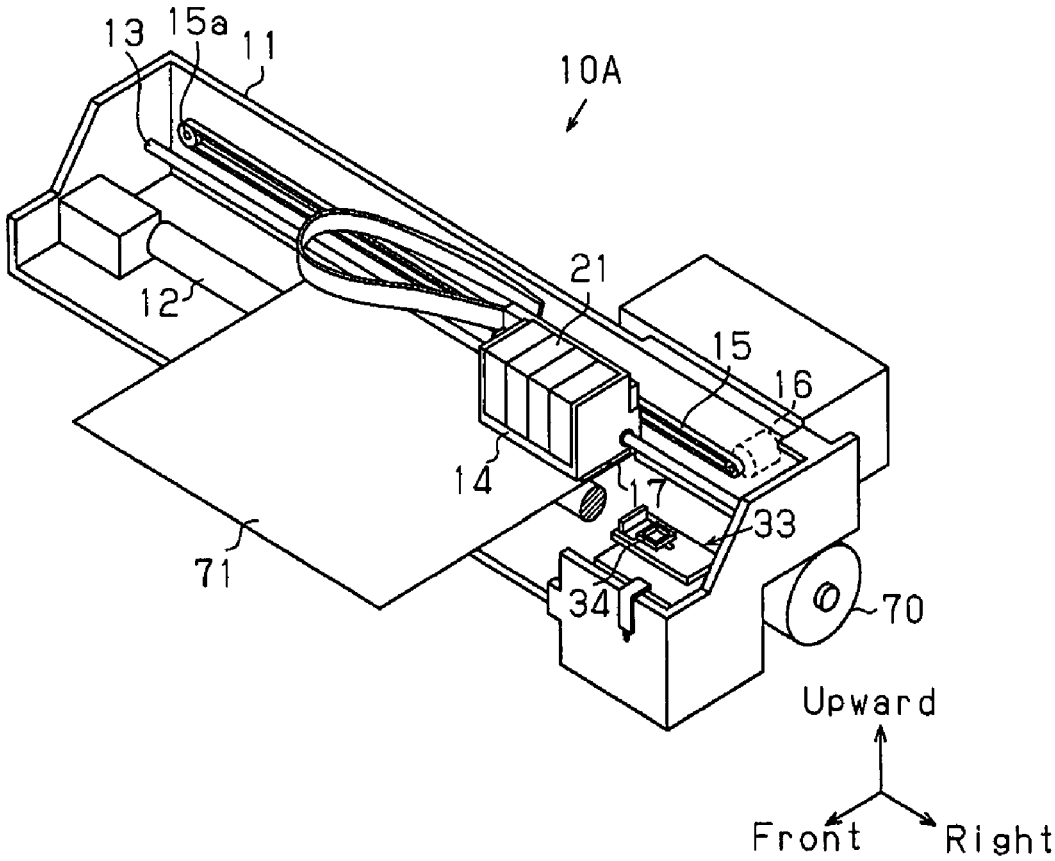
FIG. 9 is a perspective view schematically showing an inkjet printer according to a second embodiment of the present invention.

As shown in FIG. 9, a printer 10A, or the liquid ejection apparatus, includes a body frame 11 having a substantially box-like shape. A platen 12 is provided in the body frame 11. A paper feeder mechanism having a paper feeder motor 70 sends a recording paper sheet 71, or a target, to the platen 12. A bar-like guide member 13, which extends parallel with the longitudinal direction (the left-and-right direction) of the platen 12, is also arranged in the body frame 11.

The guide member 13 is passed through the carriage 14 and supports the carriage 14 in such a manner as to allow the carriage 14 to reciprocate in the axial direction of the guide member 13. A recording head 17 is provided on the lower surface of the carriage 14. A plurality of nozzles 19 are formed in the lower surface of the recording head 17. A plurality of (in the second embodiment, four) cartridges 21 are removably mounted in the carriage 14 at a position above the recording head 17. Each of the cartridges 21 retains ink in such a manner as to allow supply of the ink to the recording head 17.

The printer 10A of the second embodiment supplies the ink from each cartridge 21 directly to the nozzles 19 of the recording head 17, unlike the printer 10 of the first embodiment that supplies the ink to the nozzles 19 of the recording head 17 through the ink supply lines 26. Therefore, the hydraulic head value P acting on each of the nozzles 19 of the recording head 17 is calculated using the following equation (2):

$$P=PC-PA \tag{2}$$

In the equation, P represents a value of the hydraulic head applied to each nozzle of the recording head, while PA represents the stiffness resistance of each cartridge. PC represents the hydraulic head difference, or the difference between the hydraulic head at the outlet of each cartridge and the hydraulic head in each nozzle of the recording head.

In the second embodiment, a control section 60 detects the environmental temperature T in correspondence with a signal generated by a thermistor SE1 and reads out a threshold value KI corresponding to the environmental temperature T from a ROM 63. The obtained threshold value KI is set in a predetermined area of a RAM 64. In the second embodiment, the control section 60 reads out the hydraulic head differences PC of the cartridges 21 from the ROM 63. The control section 60 of this embodiment also reads out the stiffness resistance PA of each cartridge 21 corresponding to the detected environmental temperature T from the ROM 63. The obtained stiffness resistance PA is set in a predetermined area of the RAM 64.

The control section 60 of the second embodiment calculates the hydraulic head values P using the aforementioned equation (2) and estimates the retaining amount I of the ink in each cartridge 21 from the calculation results. The control section 60 of this embodiment then determines whether the retaining amount I of the ink in each of the cartridges 21 is less than or equal to the threshold value KI for all of the cartridges 21. If it is determined that the retaining amount I of the ink in any one of ink packs 23 is less than or equal to the threshold value KI (I<KI), the corresponding one of the lamps 61 is illuminated.

The second embodiment has the following advantage in addition to the advantages (1) to (5) of the first embodiment.

(6) The hydraulic head value P of each nozzle 19 of the recording head 17 is calculated by subtracting the stiffness resistance PA of each cartridge 21 set by the control section 60 from the hydraulic head difference PC, which has been set in the ROM 63 in advance. The stiffness resistance PA corresponds to the environmental temperature T detected in correspondence with the signal of the thermistor SE1. This effectively reduces the hydraulic head value P of each nozzle 19 of the recording head 17 in correspondence with the environmental temperature T, which has been detected based on the signal of the thermistor SE1.

The illustrated embodiments may be modified as follows.

The printer 10 of the first embodiment may supply the ink from the ink packs 23 to the recording head 17 via the ink supply lines 26 solely through the hydraulic head difference PC, or the difference between the hydraulic head at the outlet 23*a* of the ink pack 23 of each cartridge 21 and the hydraulic head in each nozzle 19 of the recording head 17, without employing the pressurization unit 27. In this case, the hydraulic head value P of each nozzle 19 of the recording head 17 is calculated using the following equation (3):

$$P=PC-(PA+PB) \quad (3)$$

P represents the hydraulic head value of each nozzle of the recording head. PA represents the stiffness resistance of each ink pack. PB represents the dynamic pressure of the ink flowing in each ink supply line. PC represents the hydraulic head difference between the hydraulic head at the outlet of each ink pack and the hydraulic head in each nozzle of the recording head.

In each of the illustrated embodiments, the thermistor SE1 may be located at any suitable position in the printer 10, 10A. For example, the thermistor SE1 may be arranged in the vicinity of the maintenance unit 33.

Figure 10:
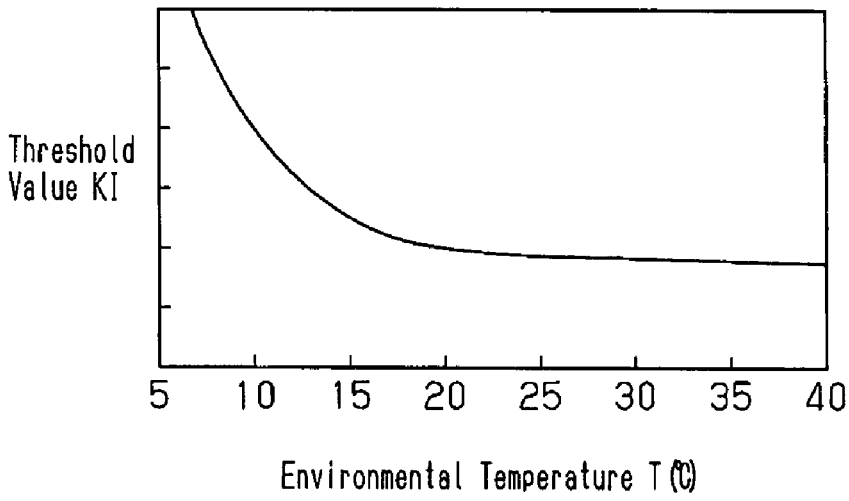
FIG. 10 is a map representing the relationship between the environmental temperature and the threshold value according to the second embodiment.

In the illustrated embodiments, the map of FIG. 10 representing the relationship between the environmental temperature T and the threshold value KI may be stored in the ROM 63. In this case, the threshold value KI is set with reference to the map. Alternatively, an equation representing the relationship between the environmental temperature T and the threshold value KI may be stored in the ROM 63. In this case, the threshold value KI is set using the equation.

Similarly, a map representing the relationship between the environmental temperature T and the stiffness resistance PA of each ink pack 23 (or each cartridge 21) may be stored in the ROM 63. In this case, the stiffness resistance PA of the ink pack 23 (or the cartridge 21) is set with reference to the map. Alternatively, an equation representing the relationship between the environmental temperature T and the stiffness resistance PA of the ink pack 23 (or the cartridge 21) may be stored in the ROM 63. In this case, the stiffness resistance PA of the ink pack 23 (or the cartridge 21) is set using the equation.

Further, a map representing the relationship between the environmental temperature T and the dynamic pressure PB of the ink flowing in each ink supply line 26 may be stored in the ROM 63. In this case, the ink dynamic pressure PB is set with reference to the map. Alternatively, an equation representing the relationship between the environmental temperature T and the ink dynamic pressure PB may be stored in the ROM 63. In this case, the ink dynamic pressure PB is set using the equation.

In each of the illustrated embodiments, the indication device is embodied by each of the lamps 61. However, the present invention is not restricted to this. The indication device may be embodied by, for example, a speaker, which gives an audio indication of the need for replacement of a cartridge 21. Alternatively, the indication device may be embodied by, for example, a liquid crystal display. In this case, a display screen of the liquid crystal display displays the need for replacement of a cartridge 21.

In each of the illustrated embodiments, the liquid ejection apparatus is embodied by the printer 10, 10A. However, the present invention is not restricted to this but may be embodied by, for example, a liquid ejection apparatus used in the manufacture of color filters of liquid crystal displays or in the formation of pixels of organic EL displays.

The invention claimed is:

1. A liquid ejection apparatus comprising:

a replaceable liquid retaining body;

a liquid ejection head that ejects a liquid supplied by the liquid retaining body through a nozzle;

a retaining amount detecting section that detects a retaining amount of the liquid in the liquid retaining body;

a temperature detecting section that detects an environmental temperature in the proximity of the liquid ejection apparatus;

a threshold value setting section that sets a threshold value, in accordance with which it is determined whether the liquid retaining body needs be replaced by a unused liquid retaining body, such that the higher the temperature detected by the temperature detecting section, the lower the threshold value becomes; and a determining section that determines whether the retaining amount detected by the retaining amount detecting section has become less than or equal to the threshold value.

2. The liquid ejection apparatus according to claim 1, further comprising:

an indication device; and a control section that activates the indication device when it is determined that the retaining amount is less than or equal to the threshold value.

3. The liquid ejection apparatus according to claim 1, further comprising a memory section that stores a plurality of threshold values in correspondence with variation of the temperature, wherein the threshold value setting section reads out a threshold value corresponding to the temperature detected by the temperature detecting section from the memory section.

4. The liquid ejection apparatus according to claim 1, wherein the temperature detecting section includes a temperature signal generating section that generates a signal corresponding to the detected temperature and a temperature calculating section that calculates a temperature based on the signal generated by the temperature signal generating section, the temperature signal generating section being arranged in the liquid ejection head.

5. The liquid ejection apparatus according to claim 1, wherein the retaining amount detecting section calculates a value of hydraulic head applied to the nozzle of the liquid ejection head and detects the retaining amount in correspondence with the hydraulic head value.

6. The liquid ejection apparatus according to claim 1, further comprising a reciprocating carriage in which the liquid ejection head is mounted, the liquid retaining body being removably provided in the carriage, wherein the retaining amount detecting section includes a hydraulic head difference memory section and a stiffness resistance setting section, wherein the hydraulic head difference memory section stores, in advance, a hydraulic head difference, which is the difference between a hydraulic head at an outlet of the liquid in the liquid retaining body and a hydraulic head in the nozzle of the liquid ejection head, wherein the stiffness resistance setting section sets a stiffness resistance of the liquid retaining body in correspondence with the temperature detected by the temperature detecting section, and wherein the retaining amount detecting section calculates a value of hydraulic head applied to the nozzle of the liquid ejection head by subtracting the stiffness resistance from the hydraulic head difference and detects the retaining amount in correspondence with the calculated hydraulic head value.

7. The liquid ejection apparatus according to claim 1, further comprising a reciprocating carriage in which the liquid ejection head is mounted, the liquid retaining body being arranged at a position other than the position of the carriage and connected to the liquid ejection head through a liquid supply line, wherein the retaining amount detecting section includes a hydraulic head difference memory section, a stiffness resistance setting section, and a dynamic pressure setting section, wherein the hydraulic head memory section stores, in advance, a hydraulic head difference, which is the difference between a hydraulic head at an outlet of the liquid in the liquid retaining body and a hydraulic head in the nozzle of the liquid ejection head, wherein the stiffness resistance setting section sets a stiffness resistance of the liquid retaining body in correspondence with the temperature detected by the temperature detecting section, wherein, in correspondence with the temperature detected by the temperature detecting section, the dynamic pressure setting section sets, as a dynamic pressure of the liquid, a total resistance acting on the liquid that has flown in the liquid supply line from the liquid retaining body to the liquid ejection head, and wherein the retaining amount detecting section calculates a sum of the stiffness resistance and the dynamic pressure of the liquid and computes a value of hydraulic head applied to the nozzle of the liquid ejection head by subtracting the sum from the hydraulic head difference, and wherein the retaining amount detecting section detects the retaining amount in correspondence with the computed hydraulic head value.

8. The liquid ejection apparatus according to claim 7, further comprising a pressurizing-supplying section that supplies the liquid from the liquid retaining body to the liquid ejection head under pressure, wherein the retaining amount detecting section has a pressure detecting section that detects a pressure applied to the liquid in the liquid retaining body by the pressurizing-supplying section, and wherein the retaining amount detecting section calculates a first sum of the hydraulic head difference stored in the hydraulic head difference memory section and the pressure detected by the pressure detecting section and a second sum of the stiffness resistance set by the stiffness resistance setting section and the dynamic pressure of the liquid set by the dynamic pressure setting section, and wherein the retaining amount detecting section calculates a value of hydraulic head applied to the nozzle of the liquid ejection head by subtracting the second sum from the first sum, and detects the retaining amount in correspondence with the calculated hydraulic head value.

9. A liquid ejection apparatus comprising:

a replaceable liquid retaining body;

a liquid ejection head that ejects a liquid supplied by the liquid retaining body through a nozzle;

a retaining amount detecting section that detects a retaining amount of the liquid in the liquid retaining body;

an indication device;

a control section that compares the retaining amount detected by the retaining amount detecting section with a predetermined threshold value and, when the retaining amount becomes less than or equal to the threshold value, the control section activates the indication device to urge replacement of the liquid retaining body;

a temperature detecting section that detects the temperature in the proximity of the liquid ejection apparatus; and a threshold value setting section that sets the threshold value such that the higher the temperature detected by the temperature detecting section becomes, the lower the threshold value becomes.

* * * * *